United States Patent [19]

Shimohiro et al.

[11] 4,424,061

[45] Jan. 3, 1984

[54] COLOR FASTNESS OF DYED COTTON TEXTILES TO CHLORINATED WATER AND PROCESS FOR IMPROVING THE COLOR FASTNESS OF DYED COTTON TEXTILES TO CHLORINATED WATER

[75] Inventors: Yoshiyuki Shimohiro, Sakai; Akio Murata, Kusatsu; Chiyoko Nisioka, Toyonaka, all of Japan

[73] Assignee: Dainippon Pharmaceutical Co., Ltd., Osaka, Japan

[21] Appl. No.: 349,673

[22] Filed: Feb. 17, 1982

[30] Foreign Application Priority Data

| | | | |
|---|---|---|---|
| Feb. 27, 1981 | [JP] | Japan | 56-28979 |
| Feb. 27, 1981 | [JP] | Japan | 56-28980 |
| Dec. 29, 1981 | [JP] | Japan | 56-211639 |

[51] Int. Cl.[3] ..... D06P 5/22; D06P 5/02

[52] U.S. Cl. ..... 8/493; 8/541; 8/561; 8/595; 8/602; 8/603

[58] Field of Search ..... 8/493, 541, 561, 595, 8/602, 604

[56] References Cited

U.S. PATENT DOCUMENTS

| | | | |
|---|---|---|---|
| 329,125 | 10/1985 | Bohme | 8/561 |
| 2,115,317 | 4/1938 | Ott et al. | 8/595 |
| 2,539,212 | 1/1951 | Strobel et al. | 8/602 |
| 3,958,927 | 5/1976 | Heer | 8/602 |

FOREIGN PATENT DOCUMENTS

| | | | |
|---|---|---|---|
| 50-58395 | 5/1975 | Japan . | |
| 55-45860 | 3/1980 | Japan | 8/541 |
| 55-152879 | 11/1980 | Japan . | |

*Primary Examiner*—Maria Parrish Tungol

*Attorney, Agent, or Firm*—Armstrong, Nikaido, Marmelstein & Kubovcik

[57] ABSTRACT

An agent for improving the color fastness of dyed cotton fibers and textiles to chlorinated water which comprises a specific diamine compound. The combination of the diamine and hydrolyzable tannin further increases the color fastness to chlorinated water. The tannin can be more strongly fixed to the fibers by further treating with a metal salt, whereby an excellent color fastness to chlorinated water can be maintained for a prolonged period of time.

11 Claims, No Drawings

COLOR FASTNESS OF DYED COTTON TEXTILES TO CHLORINATED WATER AND PROCESS FOR IMPROVING THE COLOR FASTNESS OF DYED COTTON TEXTILES TO CHLORINATED WATER

BACKGROUND OF THE INVENTION

The present invention relates to an improver for the color fastness to chlorinated water of dyed cotton textiles and a process for improving the color fastness to chlorinated water of dyed cotton textiles.

In recent years, reactive dyes have steadily increased in consumption, because of vividness in shade and good wet fastness. However, the reactive dyes have the defect of being poor in the color fastness to chlorinated water, and there are many cases where cotton textiles dyed with reactive dyes are faded or discolored due to oxidation of the dyes by the action of a trace amount of active chlorine in chlorinated water such as city water and pool water, etc.

Also, direct dyes are poor in other fastnesses as well as the color fastness to chlorinated water and have a decreasing tendency in consumption. However, they are still used, particularly for cotton textiles desired to be dyed in pale shades, for reasons of low cost, etc. The fading or color change of cotton textiles dyed with direct dyes by active chlorine also takes place frequently.

In order to eliminate the above defect, there have hitherto been proposed various prosesses, e.g. a process in which textiles are treated with resins and substances having an antioxidative property as disclosed in Japanese Unexamined Patent Publication (Tokkyo Kokai) Nos. 53693/1975, 58373/1975, 58374/1975 and 58395/1975, and a process in which fibers are treated with condensation polymeric products of polyethylenepolyamine and epihalohydrins as disclosed in Japanese Unexamined Patent Publication (Tokkyo Kokai) Nos. 152879/1980, 152880/1980 and 152881/1980. The former process is undesirable from the viewpoint of energy saving, because of requiring high-temperature treatment, though the maintenance of the effect is observed. The latter process is insufficient for the maintenance of the effect itself.

In order to solve problems as above mentioned about the color fastness of cotton textiles to chlorinated water, the present inventors have made a study on various antioxidants and have found that at least the following two points would be necessary for increasing the color fastness to chlorinated water, i.e. (1) that the oxidation potential of a compound used for improving the color fastness to chlorinated water is lower than that of a reactive dye, and the rate that the compound is oxidized is faster than the rate that the reactive dye is oxidized, and (2) that the adsorption amount of the compound to cotton fibers is large, and the compound is not easily released from the fibers in post-treatment steps such as a soaping step.

As a compound satisfying the above condition (1), there are appointed polyhydric phenols such as resorcin, hydroquinone, gallic acid, pyrogallol, Chinese gallotannin, Tara gallotannin and Turkish gallotannin, but they do not satisfy the above condition (2). For the purpose of satisfying the condition (2), the present inventors have further attempted to make these polyhydric phenols bond to cotton fibers through a compound.

It has now been found that hydrolyzable tannins can be bonded to the fibers through a certain kind of diamines with good yields and are suitable for use in improving the color fastness of dyed cotton textiles to chlorinated water, and that other polyhydric phenols such as resorcin and hydroquinone are scarcely bonded to the dyed goods by the diamines. It has also been found that the color fastness to chlorinated water can be improved even by the use of such a diamine alone, though the effect is somewhat inferior to that obtained by the combination use with the tannins.

SUMMARY OF THE INVENTION

In accordance with the present invention, there is provided an agent for improving the color fastness to of dyed cotton textiles to chlorinated water which comprises a diamine of the following general formula:

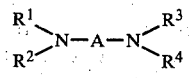

or a salt thereof wherein $R^1$ is Z—, Z—O—, Z—CO—, Z'—O—Z''— or Z'—CO—Z''— in which Z is a higher aliphatic hydrocarbon group, and Z' and Z'' are an aliphatic hydrocarbon group and at least one of Z' and Z'' is a higher aliphatic hydrocarbon group, $R^2$ is the same as $R^1$ or is benzyl group, $HOCH_2CH_2$—, $H_3C(OH)CHCH_2$— or hydrogen, $R^3$ and $R^4$ are the same or different and each is $HOCH_2CH_2$—, $H_3C(OH)CHCH_2$— or hydrogen, and A is a straight or branched lower alkylene group.

DETAILED DESCRIPTION

The term "cotton textiles" as used herein means all cotton fiber and textiles such as yarn, knitted fabric, woven fabric, nonwoven fabric, blended yarn fabric, union cloth, and knitted fabric using cotton fiber, other fibers, etc.

In the diamine shown by the general formula:

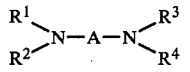

$R^1$ is Z—, Z—O—, Z—CO—, Z'—O—Z'' or Z'—CO—Z''— in which Z is a higher aliphatic hydrocarbon group having 7 to 20 carbon atoms, and Z' and Z'' are aliphatic hydrocarbon groups having 1 to 20 carbon atoms and at least one of them is a higher aliphatic hydrocarbon group having 7 to 20 carbon atoms. Typical examples of the $R^1$ group are, for instance, saturated or unsaturated hydrocarbon groups derived form beef tallow, coconut oil or soybean oil (hereinafter referred to as "beef tallow alkyl," "coconut alkyl" or "soybean alkyl"), lauryl, myristyl, palmityl, stearyl, oleyl, linolyl, linolenyl, octyl, beef alkoxyl, coconut alkoxyl, lauryloxy, myristyloxy, beef alkanoyl, lauroyl, palmitoyl, stearoyl, 3-lauryloxypropyl, 3-myristyloxypropyl, 16-ethoxypalmityl, 7-(n-hexanoxy)-heptyl, 4-palmityloxybutyl, 18-acetylstearyl, 8-isobutyryloctyl and 3-stearoylpropyl groups, and the like. The $R^2$ group is the same as the $R^1$ group, or is benzyl group, —$CH_2CH_2OH$, —$CH_2CH(OH)CH_3$ or hydrogen. The $R^3$ and $R^4$ groups are the same or different and each is —$CH_2CH_2OH$, —$CH_2CH(OH)CH_3$ or hydrogen. The group A is straight or branched lower alkylene groups having 1 to 6 carbon atoms, e.g. $—CH_2CH_2CH_2—$, $—CH_2—C(CH_3)_2—$ and $—CH(C_2H_5)—CH_2CH_2—$.

The diamines can also be employed in the form of the salt. Examples of the salts of the diamines are, for instance, salts with inorganic acids such as sulfuric acid and hydrochloric acid, and salts with organic acids such as formic acid, acetic acid and lactic acid.

The diamines and their salts (diamines and their salts being hereinafter referred to as "diamine") may be employed alone or in admixture thereof. It is not necessary to always employ the diamine shown by a single structural formula.

Further, the diamines can be employed with hydrolyzable tannins in the present invention. Examples of the hydrolyzable tannins are, for instance, Chinese gallotannin, Tara gallotannin, Turkish gallotannin, and the like.

The combination use of the diamine with the hydrolyzable tannin can further increase the color fastness to chlorinated water as compared with the single use of the diamine. In that case, dyed cotton textiles may be treated simultaneously with the diamine and the tannin in one treating bath, or in the order of the diamine and the tannin in two separate baths. The diamine and the tannin may be previously formed into an aqueous composition containing them. The composition is usually prepared by admixing an aqueous solution of the diamine dissolved in an acidic condition and an aqueous solution of the hydrolyzable tannin. In that case, the tannin is admixed with the diamine in an amount of not more than 9 parts by weight, preferably not more than 2.3 parts by weight, per part by weight of the diamine. When the mixing ratio of the tannin to the diamine is more than 9:1 by weight, the composition becomes slightly soluble or insoluble in water to produce scum, etc., and trouble such as fixing of scum to fibers is liable to occur. On the other hand, the tannin is employed in an amount of not less than 0.1 parts by weight, especially not less than 0.3 parts by weight, more especially not less than 0.7 parts by weight, per part by weight of the diamine, in order to obtain the further increased effect produced by the combination use. Also, in case of dissolving the diamine and the tannin in water in a bath and conducting the simultaneous treatment, they are also used in a ratio within the same range as above. The concentration of the diamine and tannin in the composition is not particularly limited.

The conditions for treating the dyed cotton textiles with the fastness improver of the present invention vary somewhat depending on the kind of dye and the dyeing depth. In a case where the diamine alone or a mixture of the diamine and the tannin in the form of an aqueous composition is employed as a fastness improver, the improver is usually employed in an amount of 0.1 to 10% o.w.f., preferably 0.5 to 5% o.w.f. The treatment is conducted with 5:1 to 100:1 liquor ratio at pH 2 to 6 for 10 to 30 minutes. The treating temperature is from 1° to 80° C., preferably 5° to 60° C., and it is possible to conduct the treatment at ordinary temperature through all seasons without heating or cooling a bath.

In case of conducting the treatment with the diamine and the tannin simultaneously by dissolving them in water in a bath, or in case of conducting the treatment with the diamine and the tannin in that order in separate baths, each of the diamine and the tannin is employed under the same condition as above.

Although the combination use of the diamine with the tannin can provide a better color fastness to chlorinated water than the single use of the diamine, when it is employed for dyed goods having white parts or dyed goods in pale shades, the white parts are darkened or the lightness of color is impaired due to the tannin. Therefore, users can determine whether the diamine is employed singly or in combination with the tannin in accordance with the desired degree of the fastness, the kind of dye and the dyed goods. For instance, in case of dyed goods by printing in which monochlorotriazinyl reactive dyes are widely used, the single use of the diamine is suitable. In case of dyed goods in brown which scarcely show darkening, the combination use with the tannin is suitable.

In case of conducting the treatment with the combination of the diamine and the hydrolyzable tannin, the tannin can be more strongly fixed to fibers by further treating the textiles with a metal salt. The treatment with a metal salt is desirable in order to maintain the color fastness of dyed goods to chlorinated water for a longer term. Examples of the metal salt used in the present invention are, for instance, tartar emetic, antimony chloride, antimony sodium tartrate, stannous chloride, stannic chloride, aluminum chloride, aluminum sulfate, ferrous sulfate, ferric sulfate, zinc chloride, copper sulfate, and the like. Tartar emetic, antimony sodium tartrate, aluminum chloride and aluminum sulfate are particularly preferred. The metal salt is employed in an amount of 0.1 to 5 times, preferably 0.25 to 0.5 time, the weight of the hydrolyzable tannin used. The treatment with the metal salt is conducted under the same conditions as in the foregoing treatment with the diamine alone or the combination of the diamine and the tannin, excepting the above quantitative condition.

The fastness improver and process of the present invention are applicable to all dyed cotton fibers and textiles, and are particularly useful for improving the color fastness to chlorinated water of cotton fibers and textiles dyed with reactive dyes, direct dyes or sulphur dyes. According to the present invention, there can be attained remarkable increase and excellent maintenance of the color fastness to chlorinated water which cannot be obtained by a conventional process. Further, since the treatment can be conducted at ordinary temperature through all seasons without heating or cooling a treating bath, the present invention is advantageous in energy saving. Also, the treatment according to the invention does not exert a bad influence upon other fastnesses such as wet fastness, etc.

The present invention is more specifically described and explained by means of the following Examples, in which all % are by weight unless otherwise noted. It is to be understood that the present invention is not limited to the Examples and various changes and modifications may be made in the invention without departing from the spirit and scope thereof.

In the following Examples, the treating agents shown in Table 1 were employed.

TABLE 1

| Treating agent No. | Diamine*1 | | | | |
|---|---|---|---|---|---|
| | $R^1$ | $R^2$ | $R^3$ | $R^4$ | A |
| 1 | beef tallow alkyl | H | H | H | $—CH_2CH_2CH_2—$ |

TABLE 1-continued

| | | | | | |
|---|---|---|---|---|---|
| 2 | coconut alkyl | H | H | H | $-CH_2CH_2CH_2-$ |
| 3 | soybean alkyl | H | H | H | $-CH_2CH_2CH_2-$ |
| 4 | oleyl | H | H | H | $-CH_2CH_2CH_2-$ |
| 5 | beef tallow alkyl | one is $-CH_2CH_2OH$ and others are H | | | $-CH_2CH_2CH_2-$ |
| 6 | beef tallow alkyl | $-CH_2CH_2OH$ | $-CH_2CH_2OH$ | $-CH_2CH_2OH$ | $-CH_2CH_2CH_2-$ |
| 7 | $C_{12}H_{25}O(CH_2)_3-$ | H | H | H | $-CH_2CH_2CH_2-$ |
| 8 | $C_{14}H_{29}O(CH_2)_3-$ | H | H | H | $-CH_2CH_2CH_2-$ |
| 9 | octyl | H | H | H | $-CH_2CH_2CH_2-$ |
| 10 | lauryl | H | H | H | $-CH_2CH_2CH_2-$ |
| 11 | stearyl | H | H | H | $-CH_2CH_2CH_2-$ |
| 12 | beef tallow alkyl | H | H | H | $-CH_2C(CH_3)_2-$ |
| 13 | coconut alkyl | H | H | H | $-CH_2C(CH_3)_2-$ |
| 14 | beef tallow alkyl | beef tallow alkyl | H | H | $-CH_2C(CH_3)_2-$ |
| 15 | beef tallow alkyl | benzyl | H | H | $-CH_2C(CH_3)_2-$ |
| 16 | beef tallow alkyl | H | H | H | $-CH(C_2H_5)-CH_2CH_2-$ |

| | Composition*2 | | |
|---|---|---|---|
| | Diamine | Tannin | Mixing ratio (by weight) |
| 17 | beef tallow alkyl propylenediamine (treating agent 1) | Tara gallotannin | 60:40 |
| 18 | laurylpropylenediamine (treating agent 10) | Chinese gallotannin | 50:50 |
| 19 | soybean alkyl propylenediamine (treating agent 3) | Turkish gallotannin | 40:60 |

(Notes)

*1Diamine of the general formula:

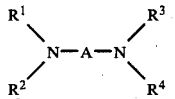

*2The composition was prepared by dissolving 50 parts by weight of the diamine in 50 parts by weight of acetic acid with agitation, on the other hand, dissolving 50 parts by weight of the tannin in 50 parts by weight of water with agitation, and uniformly admixing the both solutions to give 200 parts of the composition.

EXAMPLE 1

Aqueous solutions containing 0.05% of the respective treating agents 1 to 17 shown in Table 1 and 0.05% of acetic acid were prepared. Cotton cloths dyed with the following reactive or direct dyes at the following dye concentration were treated by dipping in the above treating solutions at 25° C. for 20 minutes with 20:1 liquor ratio, and then washed with water and air-dried. The change in the shade of the treated cloths was scarcely observed as compared with the non-treated cloths.

Dye and Concentration of Dye on the Weight of the Fiber

Procion Brilliant Blue H-A (made by Imperial Chemical Industries Ltd.): 2% o.w.f.

Procion Red HE-3B (made by Imperial Chemical Industries Ltd.): 2% o.w.f.

Mikacion Brilliant Blue RS (made by Nippon Kayaku Co., Ltd.): 4% o.w.f.

Sumifix Black B (made by Sumitomo Chemical Co., Ltd.): 1% o.w.f.

Kayarus Supra Blue BWL (made by Nippon Kayaku Co., Ltd.): 0.1% o.w.f.

The treated cloths and non-treated cloths were subjected to the following fastness test to chlorinated water (1).

Fastness Test (1)

A specimen was dipped in a buffer solution of pH 8 containing 20 p.p.m. of active chlorine with 100:1 liquor ratio, and after agitating at 25° C. for 2 hours, the specimen was washed with water and dried.

The results are shown in Table 2. In Table 2, numerical values on the column are graduation on the grey scale (provided in JIS L-0804) for assessing a change in shade, and the numerical value 5 shows the very good color fastness to chlorinated water and the numerical value 1 shows the poor one.

TABLE 2

| | Monochlorotriazinyl reactive dye | | Dichlorotriazinyl reactive dye | Vinyl sulfonyl reactive dye | Direct dye |
|---|---|---|---|---|---|
| Treating agent No. | Procion Brilliant Blue H-A | Procion Red HE-3B | Mikacion Brilliant Blue RS | Sumifix Black B | Kayarus Supra Blue BWL |
| 1 | 4 | 4–5 | 5 | 4–5 | 2–3 |
| 2 | 3 | 4–5 | 5 | 4–5 | 2–3 |
| 3 | 3 | 4–5 | 5 | 4–5 | 2–3 |
| 4 | 3 | 4–5 | 5 | 4–5 | 2–3 |
| 5 | 4 | 4–5 | 5 | 4–5 | 2–3 |
| 6 | 3 | 4–5 | 5 | 4 | 2 |
| 7 | 3 | 4–5 | 5 | 4 | 2 |
| 8 | 3 | 4–5 | 5 | 4 | 2 |
| 9 | 2 | 4–5 | 5 | 4 | 2 |
| 10 | 2–3 | 4–5 | 5 | 4 | 2 |
| 11 | 3 | 4–5 | 5 | 4 | 2 |
| 12 | 4 | 4–5 | 5 | 4–5 | 2–3 |
| 13 | 3 | 4–5 | 5 | 4–5 | 2–3 |

TABLE 2-continued

| Treating agent No. | Monochlorotriazinyl reactive dye: Procion Brilliant Blue H-A | Monochlorotriazinyl reactive dye: Procion Red HE-3B | Dichlorotriazinyl reactive dye: Mikacion Brilliant Blue RS | Vinyl sulfonyl reactive dye: Sumifix Black B | Direct dye: Kayarus Supra Blue BWL |
|---|---|---|---|---|---|
| 14 | 3–4 | 4 | 4–5 | 4 | 2 |
| 15 | 3–4 | 4–5 | 5 | 4–5 | 2–3 |
| 16 | 4 | 4–5 | 5 | 4–5 | 2–3 |
| 17 | 4–5 | 4–5 | 5 | 4–5 | 4 |
| non-treated | 1 | 4 | 3 | 2 | 1 |

As shown in Table 2, it is observed that the dyed cloths treated with the treating agent of the present invention have an excellent color fastness to chlorinated water, whereas the non-treated dyed cloths show a noticeable change in shade. Also, it is observed that the fastness is further improved by using the combination of diamine and hydrolyzable tannin (treating agent 17 in the form of aqueous composition) as compared with the use of diamine alone.

EXAMPLE 2

Aqueous solutions containing 0.05% of the treating agents 1 to 17 shown in Table 1 and 0.05% of acetic acid were prepared, and cotton cloths dyed with the following reactive or direct dyes at the following dye concentration were treated in the same manner as in Example 1. The change in the shade of the treated cloths was scarcely observed as compared with the non-treated cloths.

Dye and Concentration of Dye on the Weight of the Fiber

Procion Red HE-3B: 2% o.w.f.
Procion Yellow H-A (made by Imperial Chemical Industries Ltd.): 2% o.w.f.
Mikacion Brilliant Blue RS: 4% o.w.f.
Sumifix Black B: 1% o.w.f.
Kayarus Supra Blue BWL: 0.1% o.w.f.

The treated cloths and non-treated cloths were subjected to the following fastness test to chlorinated water (2).

Fastness Test (2)

The fastness test was carried out in the same manner as in the fastness test (1) except that the concentration of active chlorine was 50 p.p.m.

The results are shown in Table 3.

TABLE 3

| Treating agent No. | Monochlorotriazinyl reactive dye: Procion Red HE-3B | Monochlorotriazinyl reactive dye: Procion Yellow H-A | Dichlorotriazinyl reactive dye: Mikacion Brilliant Blue RS | Vinyl sulfonyl reactive dye: Sumifix Black B | Direct dye: Kayarus Supra Blue BWL |
|---|---|---|---|---|---|
| 1 | 4–5 | 5 | 2–3 | 2–3 | 2 |
| 2 | 4–5 | 5 | 3 | 2 | 1–2 |
| 3 | 4–5 | 5 | 3 | 2 | 1–2 |
| 4 | 4–5 | 5 | 3–4 | 2–3 | 2 |
| 5 | 3–4 | 5 | 3 | 2–3 | 2 |
| 6 | 3–4 | 5 | 2–3 | 2 | 1–2 |
| 7 | 4 | 5 | 3 | 2 | 1–2 |
| 8 | 4 | 5 | 3 | 2 | 1–2 |
| 9 | 4 | 3–4 | 3 | 2 | 1–2 |
| 10 | 4–5 | 5 | 3 | 2 | 1–2 |
| 11 | 4–5 | 5 | 3 | 2–3 | 2 |
| 12 | 4–5 | 5 | 3 | 2–3 | 2 |
| 13 | 4–5 | 5 | 3 | 2 | 1–2 |
| 14 | 4 | 4–5 | 2–3 | 2 | 1–2 |
| 15 | 4–5 | 4–5 | 2–3 | 2 | 1–2 |
| 16 | 4–5 | 5 | 3 | 2–3 | 2 |
| 17 | 4–5 | 5 | 4–5 | 4 | 3–4 |
| non-treated | 3–4 | 3–4 | 2 | 1 | 1 |

It is clear in Table 3 that although the degree of the increase of fastness is smaller than that in the case of the fastness test (1) because of severe testing condition, the color fastness to chlorinated water of some dyes is still excellent.

EXAMPLE 3

Cotton cloths dyed with 4% o.w.f. of the following reactive dyes were treated by dipping in an aqueous solution of pH 5 containing 2% o.w.f. of beef tallow alkyl propylenediamine (treating agent 1) with 50:1 liquor ratio at 25° C. for 20 minutes, and then washed with water and air-dried.

The dyes used in dyeing were Levafix Navy Blue E-2R (made by Imperial Chemical Industries Ltd.), Levafix Golden Yellow E-G (made by Imperial Chemical Industries Ltd.), Mikacion Brilliant Blue RS and Drimarene Brilliant Red K-4BL (made by Sandoz AG.).

EXAMPLE 4

The procedure of Example 3 was repeated except that the composition (treating agent 17 shown in Table 1) was employed instead of the treating agent 1.

EXAMPLE 5

The same dyed cloths as used in Example 3 were treated by dipping in an aqueous solution of pH 5 containing 1% o.w.f. of beef tallow alkyl propylenediamine (treating agent 1) with with 50:1 liquor ratio at 25° C. for 20 minutes, and washed with water.

The treated cloths were then dipped in an aqueous solution of pH 4 containing 1% o.w.f. of Chinese gallotannin with 50:1 liquor ratio at 25° C. for 20 minutes, and after washing with water, were dipped in an aqueous solution containing 0.3% o.w.f. of tartar emetic with 50:1 liquor ratio at 25° C. for 20 minutes, washed with water and air-dried.

EXAMPLE 6

The procedure of Example 5 was repeated except that the diamine treatment was conducted at 20° C. by employing 2% o.w.f. of laurylpropylenediamine (treating agent 10), the tannin treatment was conducted at 20° C. by employing 1% o.w.f. of Tara gallotannin and the metal salt treatment was conducted at 20° C. by employing 0.5% o.w.f. of aluminum sulfate.

EXAMPLE 7

The procedure of Example 6 was repeated except that antimony sodium tartrate was employed as a metal salt instead of aluminum sulfate.

EXAMPLE 8

The same dyed cloths as used in Example 3 were treated by dipping in an aqueous solution of pH 5 containing 2% o.w.f. of a treating agent in the form of a composition (treating agent 17 shown in Table 1) with 50:1 liquor ratio at 25° C. for 20 minutes.

After washing with water, the treated cloths were then treated with a metal salt by dipping in an aqueous solution containing 0.3% o.w.f. of tartar emetic with 50:1 liquor ratio at 25° C. for 20 minutes, and were washed with water and air-dried.

EXAMPLES 9 AND 10

The procedures of Example 8 were repeated except that the treating agent 18 or 19 in the form of a composition was employed instead of the treating agent 17.

EXAMPLE 11

The procedure of Example 8 was repeated except that the treatment was conducted at 5° C.

EXAMPLE 12

The procedure of Example 8 was repeated except that the treating agent 18 in the form of a composition was employed instead of the treating agent 17, the treatment was conducted at 5° C. and the aluminum sulfate was employed as a metal salt instead of tartar emetic.

COMPARATIVE EXAMPLE 1

The same dyed cloths as used in Example 3 were treated with Tara gallotannin by dipping in an aqueous solution of pH 5 containing 2% o.w.f. of Tara gallotannin with 50:1 liquor ratio at 25° C. for 20 minutes.

After washing with water, the treated cloths were then treated with a metal salt by dipping in an aqueous solution of pH 5 containing 0.6% o.w.f. of tartar emetic with 50:1 liquor ratio at 25° C. for 20 minutes, washed with water and air-dried.

COMPARATIVE EXAMPLE 2

The same dyed cloths as used in Example 3 were treated by dipping in an aqueous solution of pH 5 containing 2% o.w.f. of Chinese gallotannin with 50:1 liquor ratio at 30° C. for 20 minutes.

After washing with water, the treated cloths were then treated by dipping in an aqueous solution containing 0.5% o.w.f. of tartar emetic with 50:1 liquor ratio at 30° C. for 20 minutes, washed with water and air-dried.

In the above Examples 3 to 12, the change in shade of the treated cloths was scarcely observed as compared with the non-treated cloths.

The treated cloths obtained in Examples 3 to 12 and Comparative Examples 1 and 2 and the non-treated cloths were subjected to the fastness test (2) and the following fastness test to chlorinated water (3).

Fastness test (3)

The specimen was dipped in an aqueous solution containing 3 g./liter of a synthetic detergent (commercial name "Kao Popinzu" made by Kao Soap Co., Ltd) which contained an oxidation bleaching agent, with 100:1 liquor ratio at 50° C., and was agitated at 50° C. for 30 minutes and washed with water. After repeating this procedure 6 times, ths specimen was dipped in a buffer solution of pH 8 containing 50 p.p.m. of active chlorine with 100:1 liquor ratio. The specimen was agaitated at 25° C. for 2 hours, washed with water and air-dried. The change in shade of the specimen was assessed on the basis of JIS L-0804.

The results of the fastness test (2) are shown in Table 4, and the results of the fastness test (3) are shown in Table 5.

TABLE 4

| | Treatment | | Dichlorotriazinyl reactive dye | | Quinoxalinyl reactive dye | |
|---|---|---|---|---|---|---|
| | Treating agent | Metal salt | Mikacion Brilliant Blue RS | Drimarene Brilliant Red K-4BL | Levafix Navy Blue E-2R | Levafix Golden Yellow E-G |
| Ex. 3 | Treating agent 1 (beef tallow alkyl-propylenediamine) | — | 2–3 | 4 | 2–3 | 2–3 |
| Ex. 4 | Treating agent 17 (composition) | — | 4–5 | 5 | 5 | 5 |
| Ex. 5 | Treating agent 1 and Chinese gallotannin | Tartar emetic | 4–5 | 5 | 5 | 5 |
| Ex. 6 | Treating agent 10 (lauryl-propylenediamine) and Tara gallotannin | Aluminum sulfate | 4–5 | 5 | 5 | 5 |
| Ex. 7 | Treating agent 10 and Tara gallotannin | Antimony sodium tartrate | 4–5 | 5 | 5 | 5 |
| Ex. 8 | Treating agent 17 (composition) | Tartar emetic | 4–5 | 5 | 5 | 5 |
| Ex. 9 | Treating agent 18 (composition) | Tartar emetic | 4–5 | 5 | 5 | 5 |

TABLE 4-continued

| | Treatment | | Dichlorotriazinyl reactive dye | | Quinoxalinyl reactive dye | |
|---|---|---|---|---|---|---|
| | Treating agent | Metal salt | Mikacion Brilliant Blue RS | Drimarene Brilliant Red K-4BL | Levafix Navy Blue E-2R | Levafix Golden Yellow E-G |
| Ex. 10 | Treating agent 19 (composition) | Tartar emetic | 4–5 | 5 | 5 | 5 |
| Ex. 11 | Treating agent 17 (composition) | Tartar emetic | 4–5 | 5 | 5 | 5 |
| Ex. 12 | Treating agent 18 (composition) | Aluminum sulfate | 4–5 | 5 | 5 | 5 |
| Com. Ex. 1 | Tara gallotannin | Tartar emetic | 2–3 | 4 | 2–3 | 2–3 |
| Com. Ex. 2 | Chinese gallotannin | Tartar emetic | 2–3 | 4 | 2–3 | 2–3 |
| Non-treated cloths | | | 2 | 4 | 2 | 2 |

TABLE 5

| | Treatment | | Dichlorotriazinyl reactive dye | | Quinoxalinyl reactive dye | |
|---|---|---|---|---|---|---|
| | Treating agent | Metal salt | Mikacion Brilliant Blue RS | Drimarene Brilliant Red K-4BL | Levafix Navy Blue E-2R | Levafix Golden Yellow E-G |
| Ex. 3 | Treating agent 1 (beef tallow alkyl-propylenediamine) | — | 1–2 | 4 | 1 | 1–2 |
| Ex. 4 | Treating agent 17 (composition) | — | 2 | 4 | 2 | 2 |
| Ex. 5 | Treating agent 1 and Chinese gallotannin | Tartar emetic | 4 | 5 | 5 | 5 |
| Ex. 6 | Treating agent 10 (lauryl-propylenediamine) and Tara gallotannin | Aluminum sulfate | 4–5 | 5 | 5 | 5 |
| Ex. 7 | Treating agent 10 and Tara gallotannin | Antimony sodium tartrate | 4–5 | 5 | 5 | 5 |
| Ex. 8 | Treating agent 17 (composition) | Tartar emetic | 4–5 | 5 | 5 | 5 |
| Ex. 9 | Treating agent 18 (composition) | Tartar emetic | 4–5 | 5 | 5 | 5 |
| Ex. 10 | Treating agent 19 (composition) | Tartar emetic | 4–5 | 5 | 5 | 5 |
| Ex. 11 | Treating agent 17 (composition) | Tartar emetic | 4–5 | 5 | 5 | 5 |
| Ex. 12 | Treating agent 18 (composition) | Aluminum sulfate | 4–5 | 5 | 5 | 5 |
| Com. Ex. 1 | Tara gallotannin | Tartar emetic | 2 | 4 | 2 | 2 |
| Com. Ex. 2 | Chinese gallotannin | Tartar emetic | 2 | 4 | 2 | 2 |
| Non-treated cloths | | | 1 | 4 | 1 | 1 |

It is observed in Tables 4 and 5 that the dyed cloths treated with the composition and then with a metal salt, or treated with a diamine, a tannin and a metal salt in that order according to the present invention show a remarkable increase of the color fastness to chlorinated water and a good maintenance of the fastness, as compared with the non-treated dyed cloths.

EXAMPLE 13

Aqueous solutions containing 0.05% of acetic acid and 0.05% of treating agents 1 to 16 and beef tallow alkyl propylenediamine/Tara gallotannin mixtures of weight ratios of 9.9/0.1, 8/2, 4/6 and 6/4 were prepared. A mercerized cotton knitted white cloth was dipped in each solution at 25° C. for 20 minutes with 20:1 liquor ratio, and was air-dried.

The chromaticity of the treated cloths was measured, and the degree of darkening was estimated by the color difference (ΔE) obtained according to the following equation.

$$\Delta E=\sqrt{(l-l')^2+(a-a')^2+(b-b')^2}$$

wherein l and l' are lightness, a and a' are chromaticity coordinates of red and green components, b and b' are chromaticity coordinates of yellow and blue components, and l, a and b are for the treated cloth and l', a' and b' are for the non-treated cloth.

The results are shown in Table 6, in which the color difference ΔE value is shown by NBS unit (National Bureau of Standards) and there is the following relationship between the numerical estimation and the macroscopic estimation.

| Macroscopic estimation | NBS unit |
|---|---|
| (1) Color difference is trace. | 0 to 0.5 |
| (2) Color difference is slightly observed. | 0.5 to 1.5 |
| (3) Color difference is appreciably observed. | 1.5 to 3.0 |
| (4) Color difference is much. | 3.0 to 6.0 |
| (5) Color difference is very much. | 6.0 to 12.0 |

TABLE 6

| Treating agent | 1 | 2 | 3 | 4 | 5 | 6 | 7 | 8 | 9 | 10 | 11 | 12 |
|---|---|---|---|---|---|---|---|---|---|---|---|---|
| ΔE | 1.0 | 0.7 | 0.7 | 1.5 | 1.5 | 1.1 | 1.2 | 1.2 | 0.5 | 0.7 | 1.3 | 1.3 |

| Treating agent | 13 | 14 | 15 | 16 | Diamine/tannin 9.9/0.1 | 8/2 | 4/6 | 6/4 |
|---|---|---|---|---|---|---|---|---|
| ΔE | 1.5 | 1.1 | 1.3 | 1.3 | 5.5 | 6.0 | 6.0 | 6.0 |

It is observed in Table 6 that the darkening of the white cloths treated with the diamine combined with the tannin is remarkable at any ratios of the tannin to the diamine, whereas the darkening of the white cloths treated with the diamine alone is trace or slight.

In addition to the ingredients used in the Examples, other ingredients can be used in the Examples as set forth in the specification to obtain substantially the same results.

What we claim is:

1. An agent for improving the fastness to chlorine of dyed cotton textiles which comprises a mixture of a diamine or a salt thereof and a hydrolyzable tannin, said diamine having the following general formula:

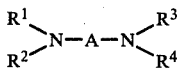

or a salt thereof wherein $R^1$ is Z—, Z—O—, Z—CO—, Z'—O—Z''— or Z'—CO—Z''— in which Z is a higher aliphatic hydrocarbon group having 7 to 20 carbon atoms, and Z' and Z'' are an aliphatic hydrocarbon group and at least one of Z' and Z'' is a higher aliphatic hydrocarbon group, $R^2$ is the same as $R^1$ or is benzyl group, $HOCH_2CH_2$—, $H_3C(OH)CHCH_2$— or hydrogen, $R^3$ and $R^4$ are the same or different and each is $HOCH_2CH_2$—, $H_3C(OH)CHCH_2$— or hydrogen, and A is a straight or branched lower alkylene group.

2. The agent of claim 1, wherein $R^1$ is a saturated or unsaturated hydrocarbon group derived from beef tallow, $R^2$, $R^3$ and $R^4$ are all hydrogens and A is —$CH_2CH_2CH_2$— group.

3. The agent of claim 1, wherein said hydrolyzable tannin is a member selected from the group consisting of Chinese gallotannin, Tara gallotannin and Turkish gallotannin.

4. The agent of claim 1, wherein the mixing ratio of the hydrolyzable tannin to the diamine is from 0.1:1 to 9:1 by weight.

5. The agent of claim 1, wherein the mixing ratio of the hydrolyzable tannin to the diamine is from 0.3:1 to 2.3:1 by weight.

6. A process for improving the color fastness of dyed cotton textiles to chlorinated water which comprises treating the dyed cotton textiles with a diamine of the following general formula:

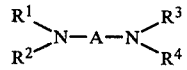

or a salt thereof wherein $R^1$ is Z—, Z—O—, Z—CO—, Z'—O—Z''— or Z'—CO—Z''— in which Z is a higher aliphatic hydrocarbon group having 7 to 20 carbon atoms, and Z' and Z'' are an aliphatic hydrocarbon group and at least one of Z' and Z'' is a higher aliphatic hydrocarbon group, $R^2$ is the same as $R^1$ or is benzyl group, $HOCH_2CH_2$—, $H_3C(OH)CHCH_2$— or hydrogen, $R^3$ and $R^4$ are the same or different and each is $HOCH_2CH_2$—, $H_3C(OH)CHCH_2$— or hydrogen, and A is a straight or branched lower alkylene group.

7. A process for improving the color fastness of dyed cotton textiles to chlorinated water which comprises treating the dyed cotton textiles with a diamine or a salt thereof and a hydrolyzable tannin, said diamine having the following general formula:

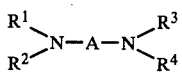

or a salt thereof wherein $R^1$ is Z—, Z—O—, Z—CO—, Z'—O—Z''— or Z'—CO—Z''— in which Z is a higher aliphatic hydrocarbon group having 7 to 20 carbon atoms, and Z' and Z'' are an aliphatic hydrocarbon group and at least one of Z' and Z'' is a higher aliphatic hydrocarbon group, $R^2$ is the same as $R^1$ or is benzyl group, $HOCH_2CH_2$—, $H_3C(OH)CHCH_2$— or hydrogen, $R^3$ and $R^4$ are the same or different and each is $HOCH_2CH_2$—, $H_3C(OH)CHCH_2$— or hydrogen, and A is a straight or branched lower alkylene group.

8. The process of claim 7, wherein said diamine and hydrolyzable tannin are employed in the form of an aqueous composition containing them.

9. The process of claim 7, wherein the treatment with the diamine and the hydrolyzable tannin is conducted simultaneously or in the order of the diamine and the tannin.

10. The process of claim 7, in which the dyed cotton textiles treated with the diamine and the hydrolyzable tannin are further treated with a metal salt.

11. The process of claim 10, wherein said metal salt is a member selected from the group consisting of tartar emetic, antimony sodium tartrate and aluminum chloride.

* * * * *